United States Patent [19]

Beman

[11] Patent Number: 4,664,540

[45] Date of Patent: May 12, 1987

[54] MECHANISM UTILIZING RESILIENT ENERGY

[75] Inventor: Ward W. Beman, Calabasas, Calif.

[73] Assignee: Bemax Corporation, Chatsworth, Calif.

[21] Appl. No.: 708,882

[22] Filed: Mar. 6, 1985

[51] Int. Cl.[4] ..... B41J 3/12

[52] U.S. Cl. ..... 400/121; 101/93.04; 101/93.48

[58] Field of Search ..... 400/121, 124; 101/93.04, 93.05, 93.29, 93.32–93.34, 93.48

[56] References Cited

U.S. PATENT DOCUMENTS

| | | | |
|---|---|---|---|
| 2,659,652 | 11/1953 | Thompson | 101/93.04 X |
| 2,686,470 | 8/1954 | Gore | 101/93.33 |
| 2,783,997 | 3/1957 | Gaffney | 272/114 |
| 3,773,320 | 11/1973 | Samiran | 272/114 |
| 4,018,155 | 4/1977 | Cargill | 101/93.33 |
| 4,070,963 | 1/1978 | Weaver | 101/93.29 |
| 4,218,149 | 8/1980 | Okada | 400/124 |
| 4,242,004 | 12/1980 | Adler | 400/124 |
| 4,349,283 | 9/1982 | Sapitowicz | 400/124 |
| 4,493,568 | 1/1985 | Estabrooks | 400/124 |

FOREIGN PATENT DOCUMENTS

| | | | |
|---|---|---|---|
| 2634184 | 2/1978 | Fed. Rep. of Germany | 400/124 |
| 3202976 | 8/1983 | Fed. Rep. of Germany | 400/124 |

*Primary Examiner*—Paul T. Sewell

*Attorney, Agent, or Firm*—Frank L. Zugelter

[57] ABSTRACT

A mechanism which greatly reduces the number of components to be manufactured and assembled, and incorporates a kinetic energy storage system into a printing arm-stylus arrangement, and by which incorporation, stored or resilient energy is utilized to provide the stylus with an initial velocity greater than zero with rebounding from impaction with a surface or the like. An auxiliary mass is resiliently or spring-related to the stylus on the one hand, and resiliently or spring-related to a cantilevered beam on the other hand. The printing arm and stylus are caused to rotate towards and from an impacting surface by means of a torque produced about a point of rotation for the stylus. A motive source of force, such as armature and electromagnet, pulls and pushes a tension means or rod disposed at a constant radius from such point of rotation, such means operatively connected to the printing arm and stylus. Superior performance in terms of speed of and time saved in motion of the stylus is achieved.

20 Claims, 7 Drawing Figures

MECHANISM UTILIZING RESILIENT ENERGY

TECHNICAL FIELD

This invention is directed to impact mechanisms, and is particularly directed or related to a unique, original and novel manufacture or mechanism, distinct over state-of-the-art teachings for impact printers.

BACKGROUND ART

Background art is exemplified in the following U.S. Pat. Nos. 1,124,150; 2,632,386; 4,172,671; 4,279,519; 4,180,334; 4,386,861; 4,389,127; 4,444,519; 4,456,394; 4,169,683; 4,169,684; 4,157,873.

The above noted state-of-the-art teachings are directed to dot-matrix printers and/or their control mechanisms. None of these teachings teach or suggest this invention or its concept.

DISCLOSURE OF THE INVENTION

A. Background

As the above noted state-of-the-art teachings disclose, a dot-matrix printer impacts upon paper in the form of series of non-connected or discontinuous dots, forming alpha-numerical characters on a sheet of paper. The operation of an assembly of such printers impact these dots swiftly or rapidly. The resulting page of print appears to a degree to be a composite of solid line alpha-numerical characters. However, it is well-known, and readily verified by a close inspection, not to be the case, as dots form each of such characters.

B. Problems in the Prior Art

Although the noted state-of-the-art teachings disclose operative and possibly commercially used devices, many problems are involved in their manufacture, and their printing results lack much in appearance to say the least. A dot-matrix printer generally comprises a number of separate mechanisms or parts many of which are required to move or guide the motion of those parts that do move. For example, see U.S. Pat. Nos. 2,632,386; 4,169,683; 4,180,334. Also, both moved and moving parts are necessarily disposed in very limited areas of dimensions. In particular, a typical dotmatrix assembly comprises an armature by which a magnetic force is transmitted to a printing stylus, via a hinge mechanism that controls the ratio of motion between armature and stylus, a helicallywound spring as part of a separate element that is assembled into and as one of the elements of a nonenergy producing mechanism that controls the positioning of the stylus, a transfer button or interfacing member [a separate piece of plastic or bearing material required to be molded to interfacing parts and which must be assembled to the matrix assembly] that mechanically transfers motion from armature to stylus and which is subject to wear, a number of intermediate guides to prevent buckling of stylus during the printing stroke, and a jewel bearing near the stylus end to control its position accurately.

Such assembly incorporates these and many other parts, requiring control of the movement of many of such parts by other parts, all of which requires tolerances of dimensions and distances that in turn require compound solutions in manufacturing the assembly steps of a dot-matrix mechanism for use in a printer apparatus.

C. Advantages of this Invention

In this invention, not only is a multiplicity of parts eliminated, but the mechanism itself includes as an integral part kinetic energy storage systems, themselves not having to be assembled, and yet operative to produce a desired impact. Assembly of a plurality of these mechanisms is far simpler. The cost of manufacture in terms of materials, assembly and time to assemble is substantially reduced. A superior performance (speed and time) is achieved in an impacting operation. A superior product incorporating this invention is effected, with a better printed appearance to the human eye through psychological realization, because of a jagged edge of a line that is produced by pixels for instant visual observation, in contrast to a pattern of "corrugated edges" resulting from circular dot impacts in today's dot-matrix printers.

D. Brief Summary of the Invention

The invention comprises a moving mechanism which utilizes a savings in its kinetic energy of motion for providing superior performance, by retaining and storing it during an impact of one of its elements upon a surface or the like. The present embodiment of the invention incorporates within a member or mechanism, without conventional assembly, a stylus upon a printing arm, the latter coupled to an auxiliary mass which in turn is coupled to a cantilevered beam. The auxiliary mass with the printing arm forms a kinetic energy storage system, and is likened to a tuning fork. As this storage system functions, its forward velocity, upon stylus impact, of the printing arm is converted to a velocity greater than zero i.e. an augmented velocity returning such printing arm towards its original location or position in the mechanism. Another kinetic storage system is formed by the cantilevered beam and the auxiliary mass, and is likened to a second tuning fork, with this system reversing or returning again the direction of the velocity of the printing arm, i.e., towards the impact location. There also is an armature from which a force initially issues, to be transmitted to the stylus, and which itself constitutes an auxiliary mass. In other words, these energy storage systems conserve and convert the kinetic energy of motion of the printing arm and stylus of the mechanism to potential and/or resilient energy upon impact, and thereafter again changes it to kinetic energy of motion. For example, with the cantilevered beam returning to an extreme position of springiness (such as by striking a stop), again the direction of velocity for the auxiliary mass, printing arm and stylus is changed, i.e., towards the location of impact.

These energy systems are united to a force-radius member to which force is transmitted from a source of motive power, example of which is the cooperative action of an armature and electromagnet. A tension means, such as a rod member, is connected to this motive power, for transmitting force to the force-radius member. The rod member is maintained at a constant radius or distance from a point of origin or distribution about which the mechanism rotates to cause a swing of the printing arm and stylus towards and from the location of impact. Flexure members are included in the mechanism to operatively connect the force-radius element and the printing arm to the point of origin or distribution. Means such as a notched, apertured block member or the like is provided to mount the mechanism in a proper disposition with other such mechanisms in an assembly to effect a mode of activity for such assembly, i.e., to provide an operation by which a printed line on a sheet of paper or the like as a consequence of the rapid impacting of stylii thereon occurs in continuous fashion. Another spring system for maintaining accurate displacement and disposition between an armature and electromagnet themselves is mounted on the tension means.

E. Objects of the Invention

An object of this invention is to effectively utilize a savings of kinetic energy of motion in a mechanism, for a superior performance for the mechanism, by retaining and storing it as potential and/or resilient energy in the mechanism during its activation, and then releasing it during such activation to achieve such superior performance in the operation of the mechanism.

An object of this invention is to provide a novel, unique, original, simpler, and distinct mechanism which effectively utilizes its own kinetic energy and its stored (resilient) energy.

A further object of this invention is to eliminate a multiplicity of parts evident heretofore in dot-matrix printer assemblies.

A further object of the invention is to provide increased or efficacious performance (time and speed) of the mechanism in its functions, whether printing or otherwise, by conserving and storing its kinetic energy of motion.

Another object of this invention is to create a greater cooling environment for the motive forces (motors) used to activate an assembly of such mechanisms, thus effectively dissipating heat generated by such forces, while not sacrificing closely arranged stylii for rapid impacting. Such creation becomes an advantageous controlling factor in a printer apparatus to obtain its maximum efficacious performance.

Another object of the invention is to eliminate component tolerance requirements for assembly and assembly problems as well, so common in the commercial embodiments of disclosures of state-of-the-art dot-matrix printers.

A still further object of the invention is to decrease the power requirements for the operation of the mechanism, and at a lesser or no additional manufacturing or assembly cost.

Another object of this invention is to rapidly impact a continuous line on paper or the like for forming a character, such as an alpha-numerical one, as distinguished from dot-matrix printer formed characters.

These and other objects and advantages will become more apparent by a complete and full reading of the following description, the accompanying drawing comprising five (5) sheets, and the appended claims.

DISCLOSURE OF BEST MODE OF THE INVENTION

A. Arrangement of Physical Elements of the Mechanism

Figure 2:
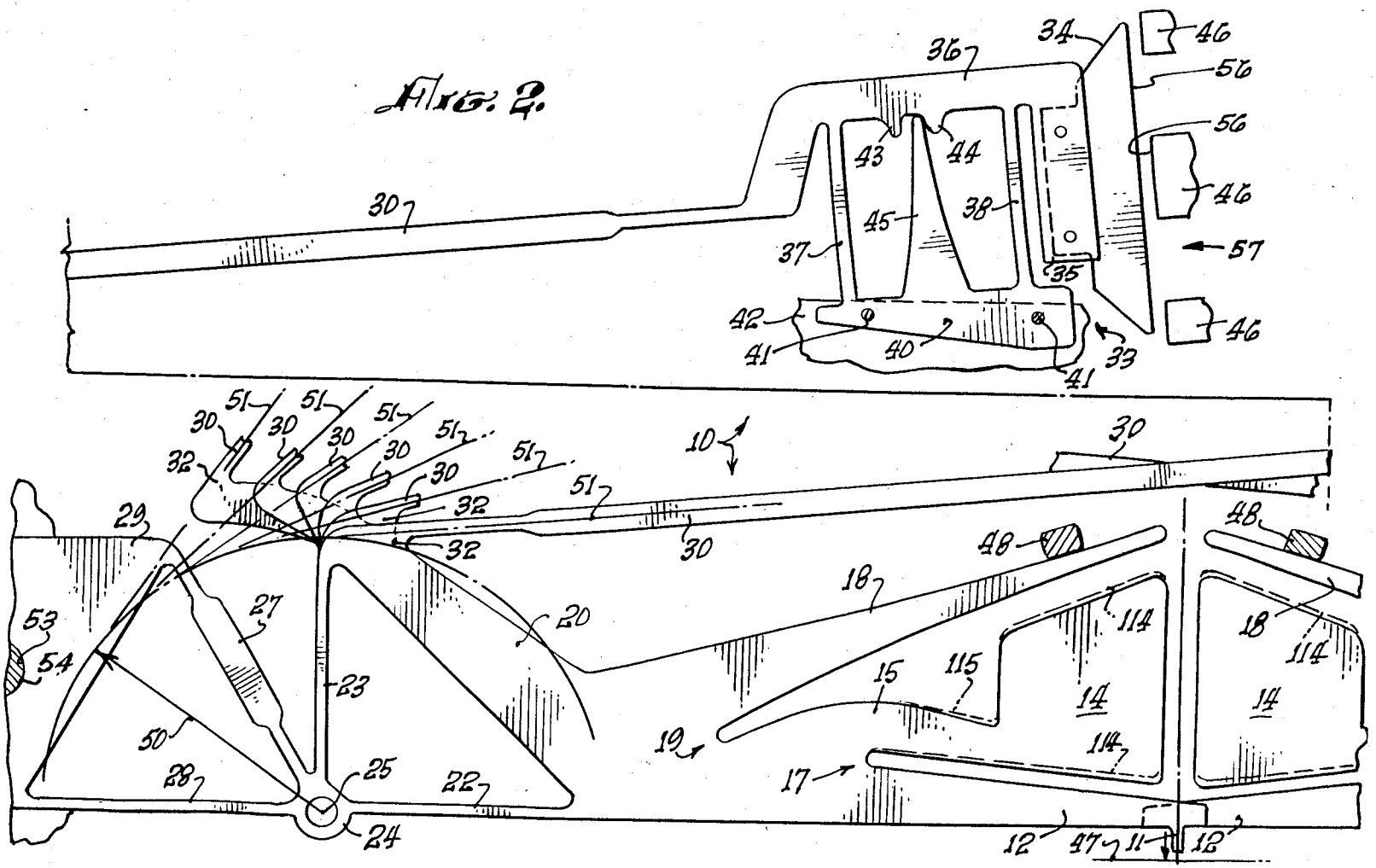
FIG. 2 is an enlarged elevational view of the mechanism of FIG. 1, shown in a non-impacting condition.
Figure 3:
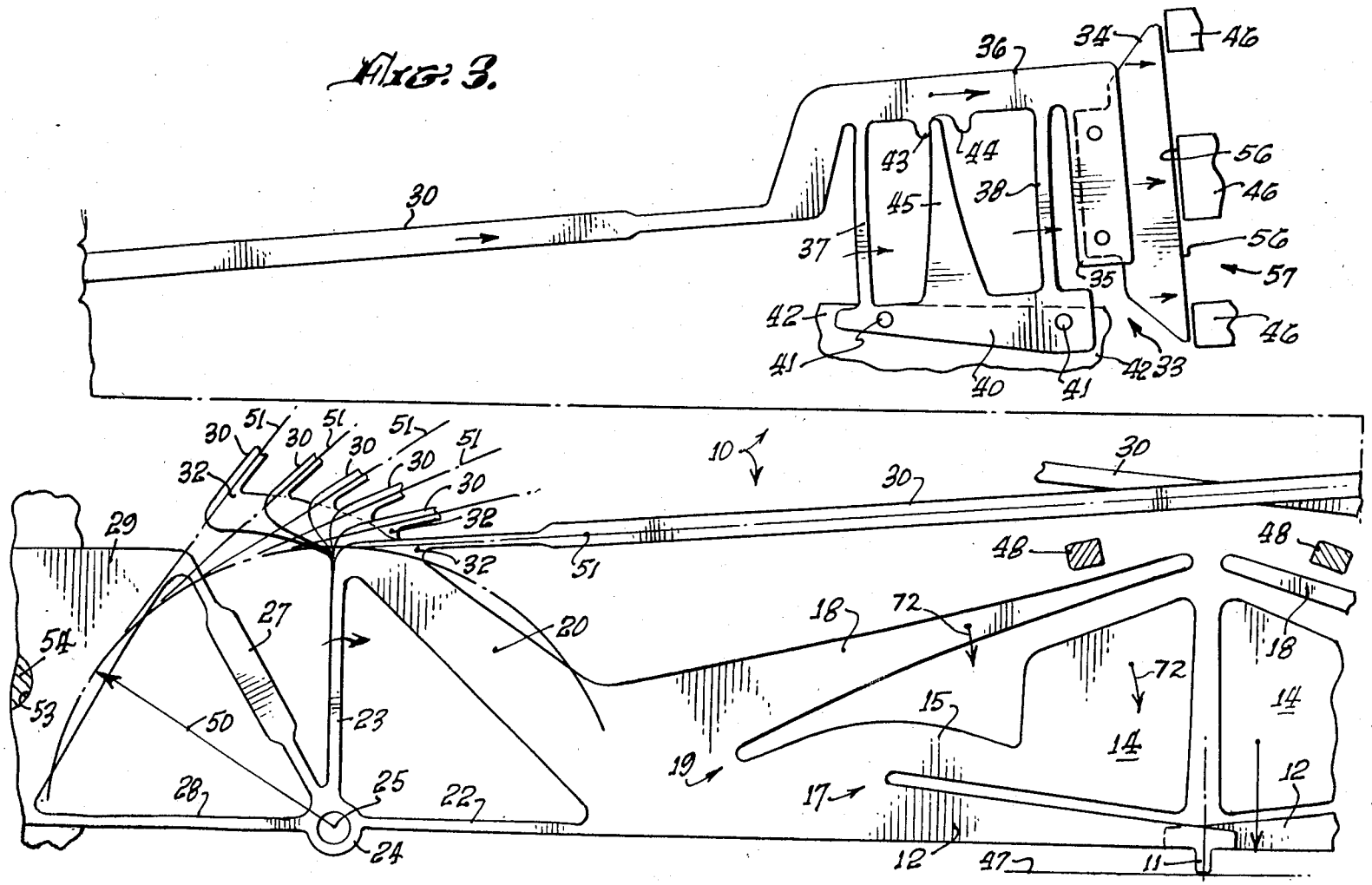
FIG. 3 is an enlarged elevational view of the mechanism of FIG. 1, shown in an impacting condition.

The manufacture comprises a thin flat piece or mechanism 10 which is etched in known manner to produce the salient elements of the subject matter embodying the invention. Mechanism 10 comprises a stylus 11 depending from a printing arm 12, preferably near the latter's terminus, a mass 14 mounted or formed on the end of its handle 15, FIGS. 2, 3, and which is free from attachment to any element in mechanism 10 except for its inclusion in handle 15. This mass means forms with printing arm 12 an assembly 17 which may be likened to a spring or tuning fork. A cantilevered beam 18 begins its formation generally in the rear area portion of the assembly 17, and extends over and in the same general direction as that of assembly 17, to form an assembly 19, which also may be likened to another spring or tuning fork between itself and the assembly 17. A force radius member 20 extends from and in an upward and opposite direction to printing arm 12 and assemblies 17, 19. Flexure members 22 and 23 connect together printing arm 12 and force radius member 20 to a formation or portion 24 of mechanism 10 which includes an origin point 25, while another pair of flexure members 27 and 28 mount mechanism 10 via its formation 24 to means, such as a blocklike member 29, for assembling a plurality of mechanisms 10 into an apparatus (not shown). A tension means 30, in this embodiment taking the form of an elongated rod member, inclines over and forwardly of, or beyond, the two assemblies 17, 19. One of its ends is attached to and near the terminal end 32 for force-radius member 20. Its length in its other direction extends beyond the end of printing arm 12 and the location of stylus 11. A spring system 33 of elements, FIGS. 2, 3, is integrally formed on the other end of member 30, while an armature 34 is suitably secured to a terminal length 35 attached to a member 36 formed on tension member 30. Spring system 33 comprises a pair of spaced, flexure arms 37, 38 which form a frame or parallelogram with member 36 and extend to a bottom member 40 adapted for securement, as at 41, to a frame member 42, FIGS. 2, 3, of an apparatus (not shown) in which a plurality of mechaisms 10 is assembled for printing operation. A pair of spaced stops or horns 43, 44, FIGS. 2, 3, depend from member 36 for retaining an end of a pedestal 45 disposed intermediate of flexure arms 37, 38 and attached to and extending upwardly from member 40. Armature 34 is correspondingly attracted to and repelled from a magnet or electromagnet 46, suitably mounted on a frame (not shown) of the printing apparatus in cooperative relationship to armature 34. It is the cooperative action of armature and magnet/electromagnet which produces the motive force for actuation of mechanism 10.

B. Purposes and Functions of the Physical Elements

Printing arm 12 positions stylus 11 for impact upon, say, a paper, platen or other surface 47, in a carriage for a typewriter, print-out apparatus, or the like. Arm 12 directly transmits for impact force developed in member 10 to stylus 11. Handle 15 functions as a cantilever spring for the auxiliary mass 14. Mass 14 forms in essence in this embodiment an auxiliary mass which is capable of storing kinetic energy (KE), by bending the assembly 17, such bending giving rise to forward and return directions and unique velocities of stylus 11 as it moves towards and away from impacting on surface 47. Any KE that is put into mechanism 10 in its operational mode is represented by the velocity of mass 14 and stylus 11. As soon as stylus 11 strikes surface 47, the spring for the auxiliary mass comes into action, tending to bounce the entire mechanism 10 in the opposite (return) direction. This auxiliary mass 14 provides by its action a means for rapidly reversing the direction of motion for stylus 11, beginning with a velocity greater than zero, without requiring the force of a magnet to overcome a strong external spring that otherwise would be or heretofore was needed to bias stylus 11 towards its home position.

The purpose of cantilevered beam 18 is the same as that of the auxiliary mass and stylus-arm arrangement. In cooperation with the auxiliary mass 14, beam 18 forms spring system 19 in principle. However, with spring system 19, there is a different spring rate than that of system 17. Auxiliary mass 14 springs to-and-fro to one side as system 19's spring rate controls, and it springs to-and-fro in the other direction as system 17's spring rate controls. Cantilevered beam 18 is actuated when mechanism 10 is in an extreme position to its position at which stylus 11 hits or strikes paper 47. In such extreme position, which is shown by its position against a frame stop 48 in FIG. 2, mechanism 10 is activated in the direction back towards paper 47 again. In other words, the functioning of assembly 19, and auxiliary mass 14 in particular, causes cantilevered beam 18 to reverse its motion, i.e., again moving towards surface 47 with an augmented reverse velocity.

It is to be noted here that such motion of mechanism 10 as it moves forward again toward surface 47 is not so effective that stylus 11 does indeed hit surface 47. The different spring rate in assembly 19 from that in assembly 17 provides this 'no-hit' result. What could or would occur otherwise would be a 'false' hit on the surface, one not desired. By way of illustration, suppose 5 hits in a row are to be made on the surface, and a sixth hit is not desired. Were mechanism 10 to bounce back towards the surface, i.e., beam 18 moving from stop 48, strongly enough, that sixth hit would occur. But the sixth or 'false' hit is not desired. Therefore, the spring rate for system 19 is different than that for system 17 to prevent such a hit.

On the other hand, a motive force, such as an electrical or magnetic pulse, is provided (via armature 34), to assist stylus 11 to indeed hit surface 47 when it is desired to do so. In the example above, such assistance would make the 5 hits, but it would not be available for the sixth hit. Otherwise, without such motive force assistance, the false hit would occur, or not hit at all.

Force radius member 20 physically transmits the motive force from armature 34 to the moving mechanism 10. The entire mechanism 10 tends to rotate about origin point 25. For mechanism 10 to rotate about origin point 25, a torque is required. The torque for mechanism 10 is applied by tension in elongated rod 30 acting at a distance from origin point 25. This tension is developed by the pull of armature 34 which is produced by a pulsing of electromagnet 46. A perpendicular distance 50, FIGS. 2, 3, separates the line of action along each tension rod 30 of such motive force from the origin point 25 which is located within the formation 24. This line of action is represented by the center line 51 of each tension rod 30, FIGS. 2, 3. Distance 50 is a radius arm or distance, not a physical arm, and is always constant, regardless of different inclinations of tension rods 30 from one mechanism 10 to another, in an assembly as shown in the outline of an assembly in FIG. 1, and does not necessarily lie within the physical boundaries of member 20. This being so, then no matter where the electromagnet 46 is located in the external boundaries of an apparatus incorporating an assembly of mechanisms 10, the torque around point 25 is the same for each electromagnet 46 in an assembly of mechanisms 10. The force radius member 20 for each mechanism 10, regardless of the noted different inclination in one mechanism 10 to another, constitutes the physical means for actually transmitting the tension force developed in elongated member 30 into the mechanism as a whole, in order to provide the required torque for moving (rotating ) the mechanism 10.

Theoretically, the forces on force-radius member 20 are such that they react as if tension rod member 30 fastens the stylus 11 at this non-physical or imaginary (force-radius) arm. This arm is a virtual arm which in actual operation controls the motions of elements in mechanism 30.

Figure 1:
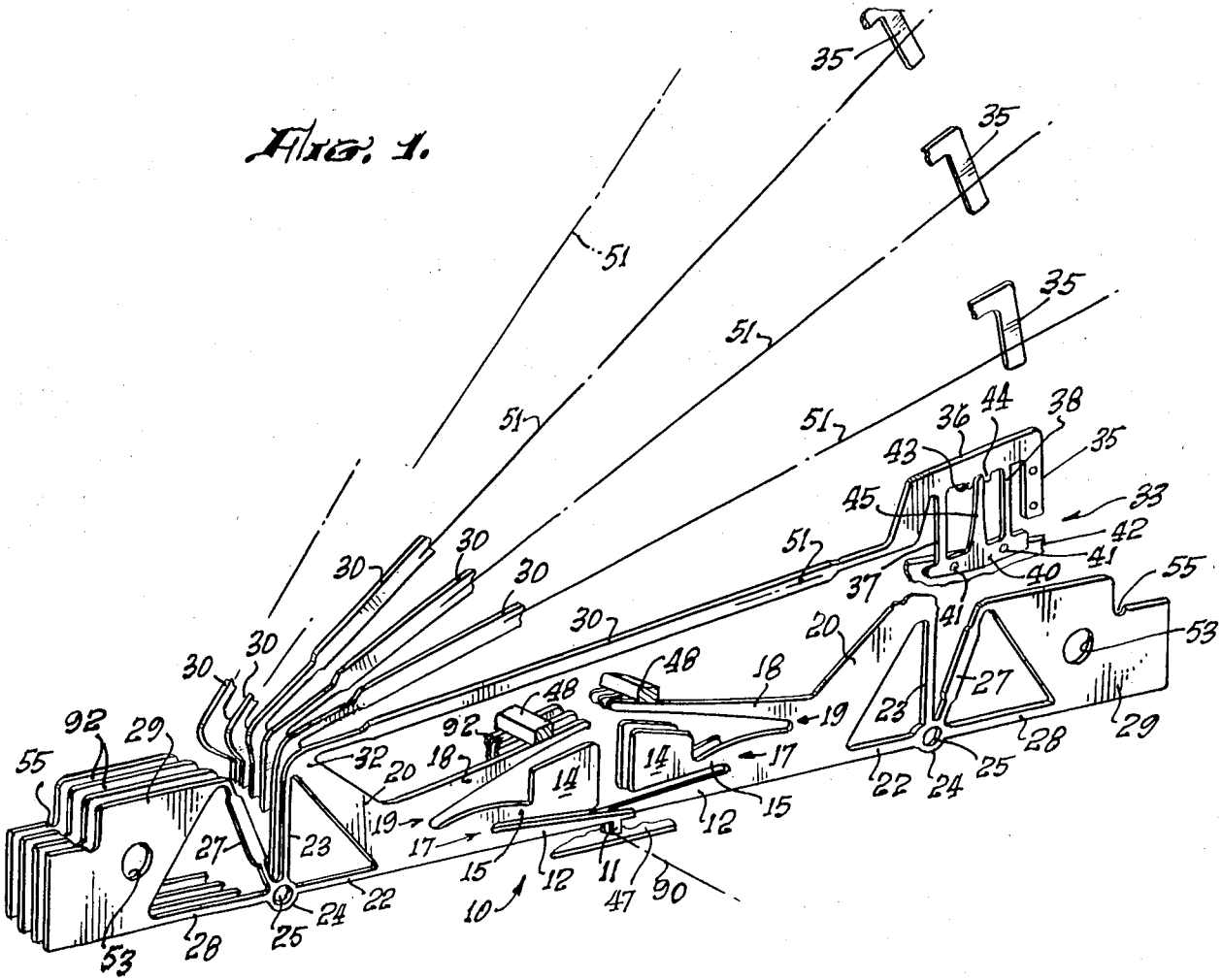
FIG. 1 is a perspective view of a mechanism embodying the invention, and in addition showing an outline of an assembly of a plurality of such mechanisms.

Block member 29 represents means such as a physical assembling member required for mounting mechanism 10 upon a frame. Its configuration is arbitrary and its form generates an aperture 53 in it, FIG. 1, for lining up a plurality of mechanisms 10 in an assembly, for a printing apparatus (not shown). An outline of an assembly is shown in FIG. 1. Bolt or rod means, or other suitable element 54, FIGS. 2, 3, is mounted through apertures 53 to hold together an assembly of such plurality.

Another frame member (not shown in FIG. 1) is located or placed across a means 55, such as a notch, FIG. 1, formed in corresponding corners of each block 29. Means 55 locates stylus 11, thus providing means for referencing to one point or corner on an apparatus frame all stylii 11 contained within an assembly of mechanisms 10.

Means 29 provides also the means for forming the base for the two flexure members 27, 28 which join formation 24 which in turn orients or locates origin point 25. Formation 24 provides for a point of distribution for forces that develop in flexure arms 27, 28 and results in the hole, formed by formation 24, becoming a virtual point. The nature or design of members 27, 28 are such that they bend (i.e., in the plane of the drawing sheet) but do not stretch. By so bending, mechanism 10 rotates about such virtual point which in practice is or is almost point 25 in the drawing. Secondary effects prevent the actual point of rotation to be consistently origin point 25, but for practical purposes, it is very close to point 25.

These members 27, 28 stabilize point 25 in both abscissa and ordinate directions, but nevertheless providing some rotation of mechanism 10 about point 25 by their bending.

Flexure arm 27 is likely to come under compression, thus, its middle portion is made thicker. To explain, with flexure arm 28, arm 27 is in tension one way or another, as tension rod 30 reacts to the pull of armature to magnet. However, as each tension rod 30 is oriented in a steeper inclination or angle to another, for assembly purposes and as illustrated in FIG. 1, there comes a point in such a steeper inclination where the push back of a tension rod 30 is (during cessation of electromagnet 30's magnetising) reacted to by a compression force in the link or flexure arm 27. The thickness of arm 27 is such, then, to prevent buckling (out of the plane of the drawing sheet), and with neighboring mechanisms 10 or separator cards between adjacent mechanisms 10, it won't buckle.

Member or rod 30 is primarily in tension, but at certain moments of time in operation it is in compression, i.e., during the activity of movement for mechanism 10. Rod 30 is designed with sufficient width to provide a stiffness (in the plane of the drawing sheet) to eliminate secondary vibrations. Too little stiffness, of course, could cause, in compression, a bending out of shape (in the plane of the drawing sheet). It should be understood that some experimentation in etching the width of rod 30 may be required for a given mechanism 10 to obtain a desired degree of stiffness, to prevent such bending. Sufficient stiffness in the plane of the motion is desired, and it is to be remembered that in assembly each member 30 can be supported by neighboring members 30, or separator cards (not shown) if necessary.

Each member 30 is supported at its end by spring system 33 of elements connected to frame 42. Rod member 30 moves with the face of armature 34 in a parallel manner to the face of electromagnet 46 mounted (not shown) in stationary manner. The invention presently contemplates in this embodiment a parallelogram-like configuration or frame for members 37, 38 relative to member 36 and rod 30. The location of pins 41 upon frame 42 ensures parallel alignment between the faces 56 of the armature 34 and electromagnet 46, these faces 56 cooperating in the operation of the invention.

The pair of spaced horns 43, 44 depends from member 36 to capture the upwardly-extending pedestal 45. Pedestal 45 functions as a stop to control limits of motion of armature 34 whose face 56 does not make physical contact with the faces 56 of electromagnet 46 (see FIG. 3). FIG. 2 illustrates pedestal 45 abutting horn 44, and FIG. 3 illustrates pedestal 45 abutting horn 43. Pedestal 45 is designed to function as a spring, having spring characteristics desirable for the face 56 of armature 34, while functioning in the same manner as the kinetic energy storage system heretofore described.

Armature 34 is mounted very close to electromagnet 46 for the former to be attracted strongly by the latter, and is aligned accurately thereto, i.e., it moves only in a linear fashion relative to electromagnet 46. In prior art devices, to obtain proper or accurate alignment, a rubber friction bearing is usually required, to control armature position relative to a magnet. Such a bearing sometimes takes the form of a brass sleeve, the center of such sleeve being a guide for the armature and the remainder of the sleeve being fastened to the magnetic coil around the magnet. It will be seen now that more parts are involved in such prior art devices, along with assembly problems for them, for maintaining accurately controlled dimensions, all of which lead to time, efforts and expenses in effecting proper or accurate alignment. Horns 43, 44 eliminate the necessity for any kind of guide or magnet, nor is there any friction for armature 34 to overcome. The springiness of members 37, 38 contributes to a total spring force needed to center this alignment and hold it in a neutral position when the mechanism is inactive. The parallelogram configuration provides a means for accurately positioning armature 34, the configuration being based on an original dimensioning which is photo-transcribed to mechanism 10 during its etching manufacturing processes. As a result, an external frame, member or component (not shown) is utilized for mounting or containing all electromagnets 46 in the assembly of a plurality of mechanisms 10, one for each tension rod 30. The faces 56 of electromagnets 46 can be readily positioned in a jig during the construction or such outer or external supporting member so that the electromagnets align and fit perfectly to positions with their corresponding armatures which have been separately located as a result of the etching process on each member 10, and in particular, in view of different inclined positions for tension means 30. Another consequential advantage here is the absence of tolerance, friction, or positioning of the two elements, the armature and the electromagnet.

It is noted that tension rod member 30 in each member 10 to the left in FIG. 1, is inclined at a different inclination to those of tension rod members 30 in other members 10 to the left.

This inclination or "stacking" technique resolves assembly problems for a commerical embodimen of the invention. Such stacking arrangement also is utilized for the plurality of members 10 that are shown in the right side of FIG. 1. This stacking technique in no way causes a change in the radius or perpendicular distance 50 utilized in the torquing or each mechanism 10.

It also may be noted here that the location of spring system 33, in a stacking arrangement, need not necessarily be disposed in an arcuate configuration suggested in FIG. 1, i.e., one in which each of the lengths of tension rod members 30 is of the same length as the next. The invention also contemplates the utilization of different lengthened tension rod members 30, so that a spring system 33 on the end of a rod member 30 in such stacking arrangement can be mounted directly above, below or beyond the tension rod member 30 of an adjacent mechanism 10.

C. Operation

In operation, as current in applied to electromagnet 46, it attracts armature 34. Tension is developed in rod 30 by the pull of electromagnet 46 on armature 34. As this occurs, mechanism 10 rotates (clockwise, FIGS. 1-3) about origin point 25. Stylus 11, FIG. 2, on printing arm 12, rotates in the plane of the drawing, to impact or strike upon surface 47, FIG. 3. The result is the printing of a character as defined by the physical limitations of the face of stylus 11.

Although stylus 11 has halted by striking surface 47, auxiliary mass 14 is continuing to move towards the surface with the same velocity as that with which stylus 11 struck surface 47. Its kinetic energy of motion is now translated into resilient energy and becomes available to stylus 11 in subsequent motion. This resilient energy provides the latter with an augmented reverse velocity as it departs from the surface 47 after impact.

With electric current stopped in electromagnetic 46, no attraction for armature 34 occurs. Consequently, mechanism 10 now rotates in the opposite direction (counter-clockwise, FIG. 1) as the result of the compressive forces existing in its physical elements. With this counter-rotation of mechanism 10, stylus 11 departs from its impactation with surface 47, utilizing the resilient energy of auxiliary mass 14 to do so with an augmented reverse initial velocity greater than zero.

As mechanism 10 thus is rotated counter-clockwise, cantilevered beam 18 strikes frame stop 48. Again, auxiliary mass 14 continues to move in this instance towards frame stop 48, developing a resilient energy for utilization towards an initial velocity greater than zero for cantilevered beam 18 as it departs from frame stop 48, towards surface 47. As the spring rate for assembly 19 is different than the spring rate for assembly 17, such resilient energy, and consequently, the augmented velocity greater than zero for beam 18, will not be the same as it was with regard to stylus 11, in its departure from surface 47.

Thus, by a continuous or repetitious actuation of mechanism 10, by the pull and "non-pull" developed by the motive force of armature and electromagnet, stylus 11 is caused to impact upon surface 47 in a series of impressions and whose physical configurations are dependent on the face or pixel of stylus 11 itself. Phantom lines 114, 115, FIG. 2, illustrate the extent of the bounced or rebound positions of auxiliary mass 14 and its handle 15.

D. Theory of Movement of Mechanism 10 to and from Platen 47

Stylus 11 moves in order for mechanism 10 to be operative, i.e., impact made. Stylus 11 is moved by motive power, such as a motor or the like, and in this embodiment, electromagnet 46 and armature 34 function as that motor 57. By its nature, motor 57 necessarily includes iron or compound(s) thereof, as well as possibly related alloying materials. All of these materials are relatively heavy. Now, in the effort of moving stylus 11, work is performed. Motor 57 is heavy. It is desirable to move it as small a distance as possible because it takes less time to move a smaller distance than it does to move a larger distance. With reference to the distance which stylus 11 must move, for example, arbitrarily a thirty-thousandths of an inch, a gear or differential ratio is established between its motion or distance and that of armature 34. Stylus 11 is a light element and readily traverses the distance of thirty-thousandths of an inch in a short time. In view of its heavierness of weight of material, the distance armature 34 moves must be less than the distance moved by stylus 11. In other words, the advantage here is that with the distance armature 34 moves being less, a lesser accelerating force for stylus 11 is required. Mechanism 10 provides this differential ratio between the distance the material of armature 34 has to move and the distance that stylus 11 has to move in order for each to accomplish its respective duty. In such a smaller motion for the material of armature 34, it need not accelerate very much in order to travel or traverse its distance. The cardinal principle here is to keep a heavier material moving a smaller distance while a lighter material can move a larger distance.

The essence of the moving system of this embodiment of the invention comprises the armature 34 and stylus 11. And it is the iron armature 34 that is driving this moving system. The instant result to be obtained by this essence is a proper pressure of impact that produces a print image on a surface, such as a paper or the like, and such print image requires mass to do so. Also, in this invention, a delicate balance is required between acceleration and mass requirements of the moving parts in the moving system. To obtain this balance, an ability to control mass distribution in the moving system is required, as the distances of movement for armature 34 and stylus 11 are substantially and essentially fixed.

Theoretically, each and every part of a moving system is a store of kinetic energy (KE). This store of KE equals ($\frac{1}{2}$) mass times the square of the velocity of each and every individual part in the moving system. The kinetic energy is furnished by a motor, and in this invention, by actuated armature 34. To actually do the printing, only the parts of the moving system which are fairly near stylus 11 can actually add to the hitting pressure that makes the print character. Were no mass there (zero), there would be no pressure when stylus 11 hits. On the other hand, if all mass is located at the print character, which is coexistent in time and space with the point of highest speed in the moving system, a longer time would be required to accelerate the mass to this necessary speed. Consequently, the moving system can not or would not operate rapidly which is a result being sought. A hard hit would occur, yes, but the movement would accelerate slowly. So on the one hand, a rapidly moving mass is desired in order to make a firm impact or imprint, and on the other hand, a large amount of mass is desired to be moved slowly as possible in order that it would not need much acceleration. And consequently, not much time to make a printed character. Therefore, by distributing the mass of the moving system properly, one can achieve the instant result desired. This invention does this. Some of the mass, which necessarily resides in the stylus 11, is fixed. However, an additional or auxiliary mass is placed into mechanism 10 in a location which (1) augment(s) the printing pressure of stylus 11 and (2) is located in a position to retain some of the kinetic energy that has been put into the moving system by its motive source of power. This auxiliary mass in this embodiment is in element 14. In this distribution of mass of the moving system, here, in mass 14, the kinetic energy that the motor has put into the mass is saved, and that mass is, concurrently, located to reflect a print force when stylus 11 hits the surface. Further, such auxiliary mass has retained kinetic energy in form of resilient energy to help speed the return acceleration of stylus 11 by providing an augmented reverse velocity after impact. Thus, it should be apparent now that storage of kinetic energy is located in or built into mechanism 10 in an auxiliary mass the form (not necessarily its location relative to the stylus' location) here being in the nature of mass 14.

In the embodiment which is disclosed, mass 14 is the auxiliary mass in which kinetic energy is stored during actuation and operation of the mechanism. However, such an auxiliary mass also can be the armature of the motor or motive force which drives the mechanism. In the above described embodiment, therefore, the mass of the armature itself can be considered to be part of the auxilary mass also.

The basic principle is that when printing action starts, the mass of the mechanism is initiated into motion, with all parts of the mechanism in motion. The only element which halts is the stylus itself. Whereas, certainly to some degree, the masses of the other elements of the mechanism remain in motion or continue to move.

By resiliently connecting the moving masses to the stylus, energy is conserved and can be utilized in a repetitious operation of the mechanism, with improved performance resulting.

The theoretical and real effect achieved by stylus and auxiliary mass before, during and after an impact is illustrated in FIGS. 4, 5, 6 and 7.

Figure 4:
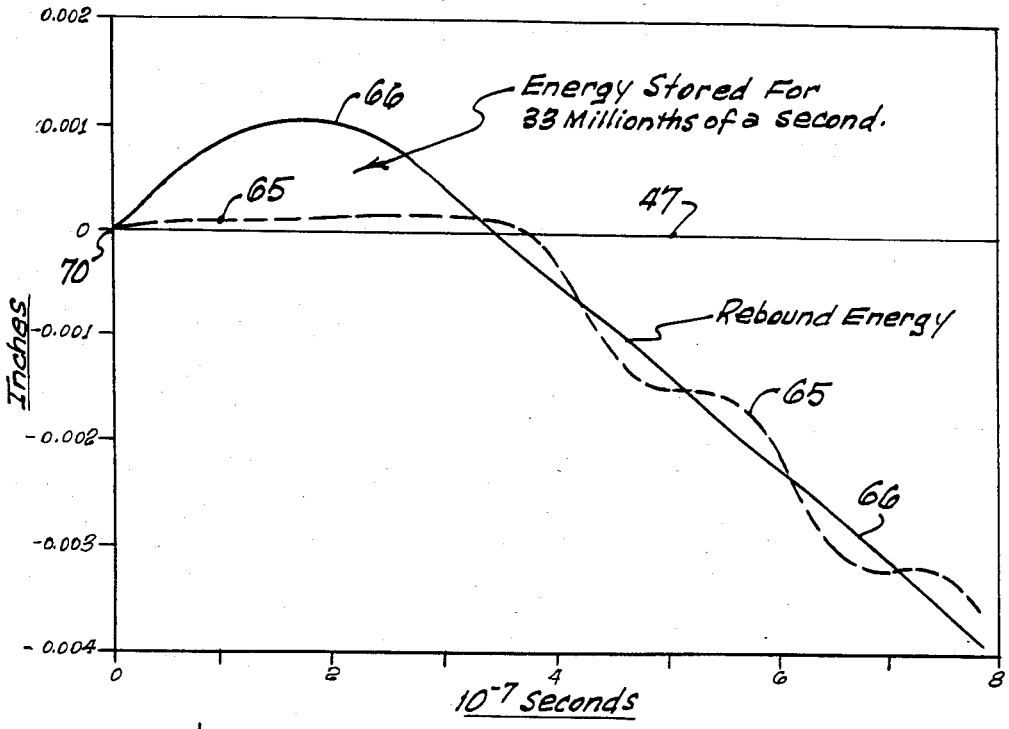
FIG. 4 is a graph which plots time versus distance for an impacting element (stylus) and a kinetic energy storage system (auxiliary mass), with their relationship demonstrating stored energy for further utilization after impacting.

FIG. 4 is a graph that charts movement (ordinate axis) against time(abscissa). Two curves are presented, one for the stylus 11, and the other, for mass 14. Curve 65 is developed for stylus 11. Curve 66 is developed for mass 14. In this illustration, relative to FIG. 4 and the following description, it is assumed that both elements are moving at the same speed immediately prior to impact of stylus 11 upon surface 47. This assumption is shown at 70, the moment or instance of impact on surface 47. The 0 (zero) reading on the graph is equated to the surface 47. The scale of distance (ordinate) is in thousandths of an inch. The scale of time (abscissa) is in tens of millionths of a second.

Curve 65, i.e., a movement of stylus 11 over a period of time from impact on, shows that immediately after contact with surface 47, it penetrates or indents the surface and stays in contact with it for approximately 35 microseconds. Thereafter, it bounces away from surface 47 and starts on an erratic return path towards a home position. A home position is one in which the elements of mechanism 10 are relaxed, i.e., no stress is imposed upon them, as in the case when mechanism 10 is not actuated.

Meanwhile, the path of the auxiliary mass, i.e., of mass 14, is shown to continue on, after impact, in thousandths of an inch, at a speed that it had at the moment the stylus impacted surface 47. It slowly reduces its speed as the spring force between it and stylus 11 builds up as a result of the narrowingly relative displacement between the two (see distances in FIG. 3, identified as arrows 72), until finally it is brought to a stop at approximately 18 microseconds after the initial contact of stylus 11 with surface 47. At this point in time, at 18 microseconds, stylus 11 is being pressed with maximum force against surface 47, due to the elasticity between it and the auxiliary mass. This maximum force continues to act on the auxiliary mass and now begins to accelerate it back towards its home position. The potential or resilient energy, shown in the graph as stored kinetic energy and represented by the area bounded by curve 66 and surface 47, has accumulated, by reason of the resilence of the elastic material of the auxiliary mass, and is being converted back into kinetic energy of motion, this process shown as being completed at approximately 33 microseconds after first contact of stylus 11 upon surface 47.

At this point in time, 33 microseconds after such contact, the auxiliary mass "picks up" stylus 11 from surface 47 at an average velocity, greater than zero, nearly equal to the velocity they had immediately prior to impact, i.e. with an augmented velocity and both now move back towards their respective home positions. In actual practice, the relative oscillatory motion between auxiliary mass and stylus on the return trip to their home positions soon dampens out due to inherent, internal friction of the material of mechanism 10 itself.

The fraction of the initial (at impact) energy in the auxiliary mass that is saved depends on the ratio of the auxiliary mass to the mass of the stylus. Nearly all of the energy of the stylus is lost on impact. The operation of the mechanism depends, therefore, on the choice of mass ratios and the interconnecting spring or resiliency constants. With knowledge of this choice, it is to be noted that the location and the arrangement of the auxiliary mass, here, element 14, and the stylus mass is immaterial, so long as they are connected by a resilient material that is capable of storing and returning the deformation of the energy.

In a mechanism wherein the mass of the motive power supply may be significant (and usually is) it, too, becomes part of the auxiliary mass referred to in the above description.

The area under curve 66, extending down to the surface 47, represents energy stored in the auxiliary mass for a period of time (35 millionths of a second), during the maximum impact of stylus 11 on surface 47. Such area represents a fractional savings of the kinetic energy in such auxiliary mass.

The illustration and its description provided above in regard to assembly 17 at impact is representative also of assembly 19 at time of cantilevered beam striking frame stop 48. The same curves develop, but with a different spring rate in assembly 19, the stored energy for initiating a velocity greater than zero for beam 18 from frame stop 48, and the value of such initial or augmented velocity being, of course, not the same as that for stylus 11. And this is generally true with regard to any resilient relationship of auxiliary mass to an element in a mechanism 10, in the combination of which the effect of an initial velocity greater than zero is imparted to such element or to another element in mechanism 10, and by which a rapid moving system is efficaciously achieved.

Figure 5:
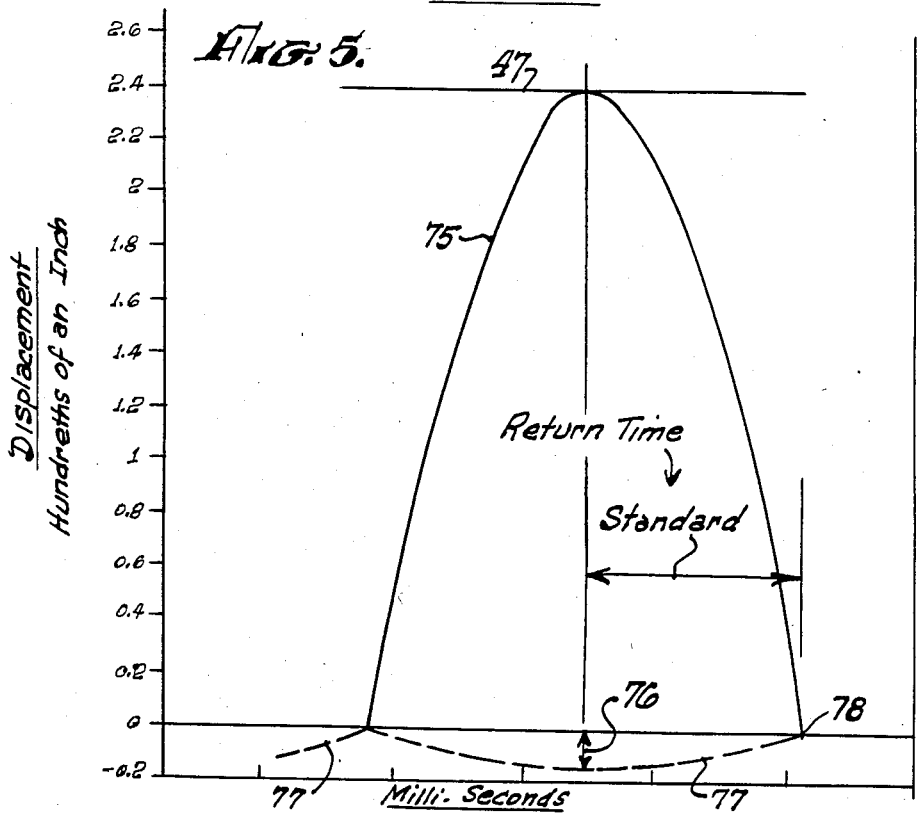
FIG. 5 is a graph which plots time versus distance of a state-of-the-art stylus as it moves to and from an impacted surface, and for illustrative purposes a superimposed second curve showing force of an external spring required to return the stylus from such surface.
Figure 6:
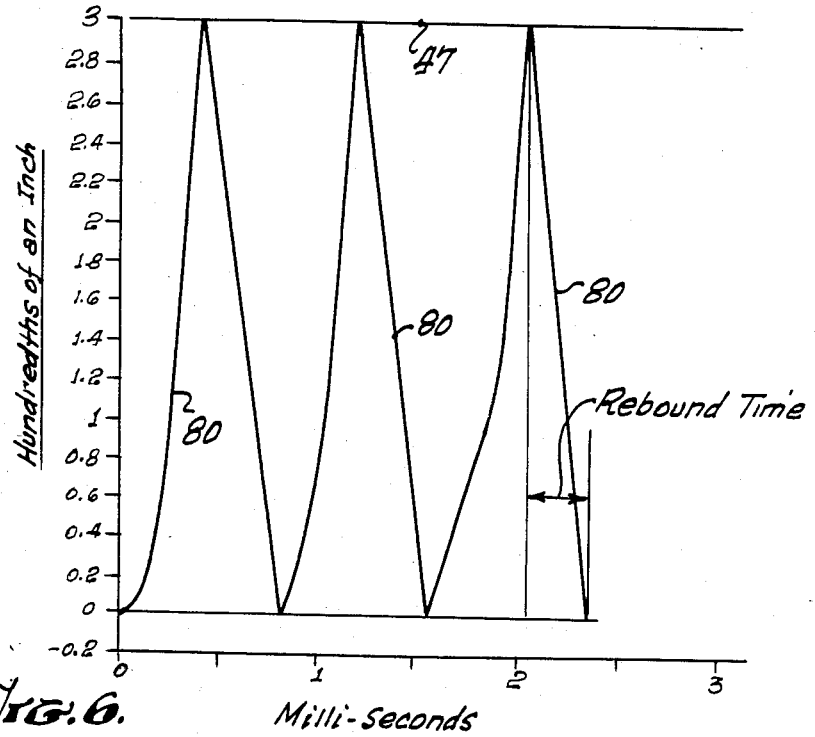
FIG. 6 is a graph which plots time versus distance of an impacting element comprehended by this invention, demonstrating the fact that such element leaves an impacted surface with an augmented reverse velocity, contrary to the zero or parabolic velocity shown in FIG. 5 with which a state-of-the-art stylus leaves an impacted surface.
Figure 7:
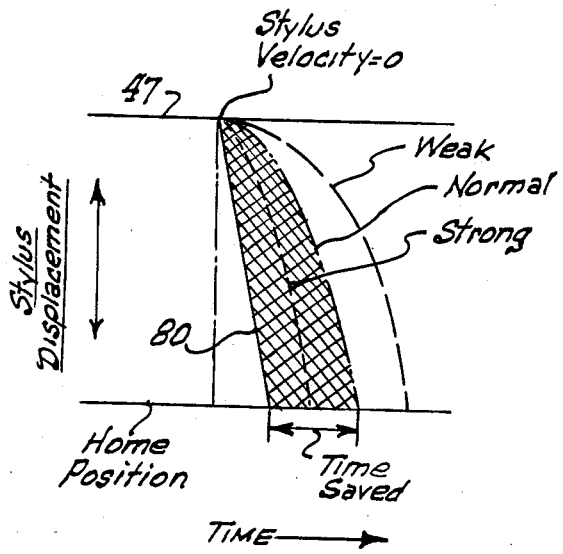
FIG. 7 is a schmatic composite graph plotting time versus distance, demonstrating the superior performance for the subject matter of this invention over that of state-of-the-art devices.

FIGS. 5, 6, and 7 show the advantageous effect of saving at least 20% for the retained kinetic energy in the auxiliary mass, for improving the performance of stylus 11. These graphs show the importance of conserving the kinetic energy of motion in the auxiliary mass, by making a comparison of the time it takes to return to home position, from surface 47, for two different systems of motion, that is, system of motion for a non-conservative system and a system of motion for a conservative system. In one, the auxiliary mass does conserve kinetic energy, and in the other, the stylus does not conserve its initial kinetic energy.

Generally, in a scientific vein, in a non-conservative system, the stylus and everything connected to it comes to a complete halt during the printing impact. All of these connections must be accelerated from a zero velocity, i.e., one with which no kinetic energy of motion can be utilized, back towards the home position for the stylus by an external spring force. The stronger the spring, the faster the return trip. However, such a spring acts against the driving motive power for the stylus in the first place. These two forces are at odds-end with each other, and consequently, slowing the strike velocity for the stylus on the surface. The best operation heretofore has been a compromise between a fast forward and fast return system for the stylus. In all cases, however, the non-conservative system must start its strike at essentially zero velocity, with no utilization of any kinetic energy accelerating to its final velocity at paper 47, following a time-distance projectory that is essentially parabolic in shape.

This parabloic projectory in a non-conservative system of motion is illustrated in FIG. 5, by curve 75. At the moment of impact at surface 47, the velocity of the stylus becomes zero, and the external spring force required to return the stylus to its home position is the strongest at this point in time, this force being illustrated by the distance 76, FIG. 5, that separates a curve 77, illustrating such external spring force, from the abscissa in FIG. 5, the abscissa representing home position for the stylus. [Note: curve 77 is not correlated to the x-y variables of the graph in FIG. 5, but merely imposed thereon to assist as a pictorial explanation (accompanying this description) of the functioning of the external spring force, in time, relative to the movement of a stylus, in time.] There is no opportunity for any kinetic energy transfer to take place. So, with zero velocity for the stylus now at surface 47, a certain amount of time, again parabolically developing, elapses for the stylus to return to its home position, as at 78. This amount of time represents a standard amount of time required in a non-conservative system, necessary for the stylus to return to its home position, after reversing its direction of motion at surface 47, beginning thereat with an initial velocity of zero i.e., one having no augmentation arising out of stored kinetic energy.

The graph of FIG. 6 represents movement in time of a stylus in a conservative system, and which exemplifies the movement of stylus 11 of this invention. Stylus 11 moves to and impacts upon surface 47, as shown by curve 80, and it is to be noted that no external spring force is causing the stylus to leave surface 47. Upon such impaction, the kinetic-turned-resilient energy of auxiliary mass 14, and others if it be the case, is available to start the return of stylus 11 with a velocity greater than zero as it leaves surface 47. And it arrives at its home position in less time than the stylus of FIG. 5. A comparison of FIGS. 5 and 6 shows that while as little as 20% of the kinetic energy of the auxiliary mass system is saved, the full return trip for the stylus takes only 0.25 milliseconds. A significant increase in performance, in terms of speed and time, in the motion of stylus 11, is achieved.

FIG. 7 is a schematic composite of FIGS. 5 and 6, whereon the return portions of their respective curves are imposed upon one another, to pictorially show the time saved, in operation of the invention. curve 75 is shown in three different modes of strength for an external spring that biases a stylus, in a non-conservative system, towards its home position: weak, normal, and strong. Curve 80 is shown in relation to such spring strength modes, while the shaded portion of FIG. 7 shows the difference in time saved between stylus of a non-conservative system and a stylus of a conservative system. Curve 80 is, of course, a straight line which depicts an initial velocity for stylus 11 as it leaves a surface 47, and upon reaching its home position, FIG. 7 illustrates that time has been saved in the motion of stylus 11 over that of state-of-the-art devices, thus achieving a superior performance for mechanism 10.

The present embodiment of the invention contemplates (stainless) steel material for mechanism 10, although other suitable materials may be used. Armature 34 and electromagnet 46 are of known and suitable existing materials. The springs in the instant embodiment of design, i.e., the assemblies 17, 19 and group 33 of elements, are not necessarily recognizable as such but depend on the geometry of the design and the natural resilence of the construction material which is by nature springy and resilient. Were the material glass or other substance, for example, the geometry would be different, although possibly only slightly, than in the case of stainless steel, due to the inherent differences in the mass and spring rates of such materials. The invention also contemplates integration into mechanism 10 of one or more of its elements, by means such as spot welding, in addition to utilization of conventional etching processes that produce such elements.

The present size of mechanism 10 approximates a length of one(1) inch, a three-eighths($\frac{3}{8}$) inch width, and a six-thousandths(0.006) inch thickness, although its size is not limited to such approximations, as other suitable or convenient sizes are applicable to embody the invention. Nor is its configuration limited to that shown in the drawing, the heretofore description pointing out that the kinetic energy storage systems need not be located as shown in relation to printing arm 12 and stylus 11.

Regarding an assembly of a plurality of mechanisms 10, FIG. 1, it will be seen that a plurality of them are assembled in a row one next to the other, on the left, and assembled in a row one next to the other on the right, so that the stylus 11 of each lines up along a center line 90, in a contiguous relationship one to the next. I.e., mechaisms 10 in one row face mechanisms 10 to another row, so that stylii 11 of one row alternate with the stylii 11 in the other row along centerline 90. A spacing 92 between adjacent mechanisms 10 in each of such rows occurs as a result of this form of assembly. Separator cards (not shown) can be utilized to restrict spacing 92 to the thickness of each member 10 which assures proper alignment of mechanisms 10 in each row.

Other forms of assembly of a plurality of mechanisms 10 are envisioned. For example, rather than interleaving stylii of two rows of such mechanisms, per FIG. 1, one row could be eliminated along with the spacing 92 in the row remaining, to thereby have a plurality of mechanisms their facing sides in abutting relationship. Or, another example, a number of side-by-side abutting mechanisms could constitute one row while a like number of abutting mechanisms could constitute a second row of abutting mechanisms, the stylii of both rows again in alignment with centerline 90.

It will be seen that in an assembly of a plurality of mechanisms 10, additional or greater amounts of spacing are available for use, about armature and electromagnet, and in this manner, provide a substantially larger cooling environment for them, all of which effectively dissipates generated heat thereabouts, heat always being a disliked factor in mechanical and electrical assemblies, and which contributes to problems for assembly, or in operation. With the removal of this heat-disadvantage, lower power requirements are realized.

Industrial Applicability

The immediate applicability in industry of this invention indicates that it supercedes the utilization of dot-matrix printing apparata, considered state-ofthe-art knowledge today.

I claim:

1. A print mechanism constructed from and included within a flat piece of material, said flat piece of material including an arm, a stylus mounted on said arm, and a member resiliently connected to said arm and including an auxilary mass for motion relative to said arm, the auxilary mass of said member free from attachment to any element in said mechanism except for its inclusion in said member, said auxilary mass in its motion relative to said arm functioning to convert its kinetic energy of motion at stylus impact to kinetic energy in the motion of said stylus in a reverse direction after stylus impact, thus augmenting the reverse velocity of the stylus after its impact.

2. The print mechanism of claim 1 including a cantilevered beam in a second resilient relation with said member that includes the auxilary mass for returning the reverse direction of motion of said member and said stylus into a forward motion with an augmented velocity.

3. A means which includes an element for impacting on a surface, said means in the form of and included within a flat piece of material for converting forward velocity of said element impacting on a surface to an augmented reverse velocity in a different direction, characterized by a kinetic energy storage system comprising an arm for said impacting element, a member resiliently connected to said arm and impacting element and including an auxilary mass for motion relative to said arm, the auxilary mass of said member free from attachment to any element in said mechanism except for its inclusion in said member, said auxilary mass functioning to convert its kinetic energy of motion at impact of said element to kinetic energy for said element in such different direction after impact.

4. The means of claim 3 including a second kinetic energy storage system also formed in and included within said flat piece of material in resilient relation to said kinetic energy storage system for returning said impacting element with an augmented return velocity to the direction of impact.

5. The means of claim 4 wherein said second kinetic energy system comprises a cantilevered beam spring-related to said auxiliary mass member.

6. The means of claim 3 or claim 4 or claim 5 wherein said impacting element is a stylus.

7. A print mechanism constructed from and included within a flat piece of material for converting forward velocity of an impacting element in said print mechanism to an augmented reverse velocity in a bounced direction for the element, comprising a kinetic energy storage system in said flat piece of material and including an arm connected to said impacting element, and an auxiliary mass member in resilient relation to said arm and impacting element, this resilient relation being a member of the flat piece of material and whose function is to convert the kinetic energy of motion of said auxiliary mass member at time of impact of said element to kinetic energy of its motion in such bounced direction after impact, a force-radius member operatively connected to said impacting element, a formation containing a point of distribution for forces generated in the actuation of said print mechanism, flexure means operatively connecting said force-radius member and impacting element to said formation, and tension means operatively connected to said force-radius member and by which a torque about said formation to actuate said print mechanism is developed, whereby upon an actuation of said print mechanism, said kinetic energy storage system functions to provide such augmented reverse velocity.

8. The mechanism of claim 7 wherein said element is a stylus.

9. The print mechanism of claim 7 including a second kinetic energy storage system in resilient relation to said kinetic energy storage system for returning with an augmented reverse velocity said impacting element towards the direction for impact.

10. The mechanism of claim 9 wherein said second kinetic energy storage system comprises a cantilevered beam in a second resilient relation with said auxiliary mass member, this second resilient relation being another member of the flat piece of material and whose function is to return direction of motion of said auxiliary mass member to a forward motion in the direction of impact with an augmented velocity.

11. The mechanism of claim 7 or claim 8 or claim 9 or claim 10 including means for assembling a plurality of said mechanisms on a frame.

12. The mechanism of claim 11 wherein said assembling means comprises an assembling member, flexure means connecting said assembling member to said formation, said assembling member including an aperture and a notched corner for assembling said plurality to the frame and for aligning said impacting element, respectively.

13. The mechanism of claim 7 or claim 8 or claim 9 or claim 10 in combination with means for actuating said tension means.

14. The mechanism of claim 13 wherein said actuating means comprises an armature mounted on said tension means and an electromagnet in cooperative relation with said armature.

15. The print mechanism of claim 1 or claim 2 or claim 3 or claim 4 or claim 5 or claim 7 or claim 8 or claim 9 or claim 17 or claim 20 wherein said flat piece of material comprises stainless steel.

16. The mechanism of claim 11 wherein said flat piece of material comprises stainless steel.

17. The mechanism of claim 12 wherein said flat piece of material comprises stainless steel.

18. The mechanism of claim 13 wherein said flat piece of material comprises stainless steel.

19. The mechanism of claim 14 wherein said flat piece of material comprises stainless steel.

20. The print mechanism of claim 8 including a second kinetic energy storage system in resilient relation to said kinetic energy storage system for returning with an augmented reverse velocity said impacting element to the direction for impact.

* * * * *

UNITED STATES PATENT AND TRADEMARK OFFICE

CERTIFICATE OF CORRECTION

PATENT NO. : 4,664,540

DATED : May 12, 1987

INVENTOR(S) : Ward W. Beman

It is certified that error appears in the above-identified patent and that said Letters Patent is hereby corrected as shown below:

In column 16, line 49, "claim 17" should be read as - - claim 10 - - .

Signed and Sealed this

Seventeenth Day of November, 1987

*Attest:*

DONALD J. QUIGG

*Attesting Officer*

*Commissioner of Patents and Trademarks*